US006155327A

United States Patent [19]

Wells et al.

[11] Patent Number: 6,155,327

[45] Date of Patent: Dec. 5, 2000

[54] COUNTERBALANCE SYSTEM ADJUSTMENT MECHANISM FOR ROLLUP DOOR

[75] Inventors: David M. Wells, Arlington; Craig S. Ward, Jr., Plano, both of Tex.

[73] Assignee: Overhead Door Corporation, Dallas, Tex.

[21] Appl. No.: 09/325,493

[22] Filed: Jun. 3, 1999

[51] Int. Cl.[7] ..... A47G 5/02

[52] U.S. Cl. ..... 160/310; 160/191; 160/197; 160/198; 16/198

[58] Field of Search ..... 160/191, 197, 160/198, 310; 16/197, 198; 49/200, 139, 199

[56] References Cited

U.S. PATENT DOCUMENTS

| | | | |
|---|---|---|---|
| 1,994,142 | 3/1935 | Madsen . | |
| 2,032,951 | 3/1936 | Pixley . | |
| 2,226,017 | 12/1940 | Pixley . | |
| 2,660,753 | 12/1953 | Moler . | |
| 2,932,057 | 4/1960 | Pemberton . | |
| 3,651,719 | 3/1972 | Wessel | 81/63.2 |
| 4,243,239 | 1/1981 | Whitney | 280/47.13 B |
| 4,685,184 | 8/1987 | Satkamp | 29/148.4 R |
| 4,731,905 | 3/1988 | Milano et al. | 16/306 |
| 4,871,007 | 10/1989 | Abolins | 160/201 |
| 4,882,806 | 11/1989 | Davis | 16/198 |
| 4,981,165 | 1/1991 | Miller et al. | 160/191 |
| 5,070,575 | 12/1991 | Redman et al. | 16/96 R |
| 5,239,777 | 8/1993 | Husselton | 49/200 |
| 5,419,010 | 5/1995 | Mullet | 16/198 |
| 5,577,843 | 11/1996 | Leininger | 384/275 |
| 5,778,490 | 7/1998 | Curtis | 16/198 |
| 5,884,956 | 3/1999 | Pasquin | 295/37 |

*Primary Examiner*—Bruce A. Lev
*Attorney, Agent, or Firm*—Akin, Gump, Strauss, Hauer & Feld, LLP

[57] ABSTRACT

A counterbalance spring adjustment mechanism, particularly adapted for a rollup type upward-acting door which is supported between spaced apart wall brackets on a rotatable shaft. One end of the torsion spring is connected to a hub including a tubular hub member and a circumferential radially extending flange. The tubular hub member is disposed in a bore formed in one of the wall brackets and is retained in assembly therewith by a cylindrical collar. The door support shaft is disposed in a self-lubricating polymer bushing which is supported in the tubular hub member. A reinforcing collar is fixed to the wall bracket and includes a boss formed thereon having a lock pin receiving bore for receiving a lock pin which projects through the bore in the reinforcing collar, through a slot in the wall bracket and through a selected one of a plurality of circumferentially spaced pin-receiving bores in the hub flange for locking the hub in a selected rotative position which determines the torsional windup of the torsion spring.

12 Claims, 2 Drawing Sheets

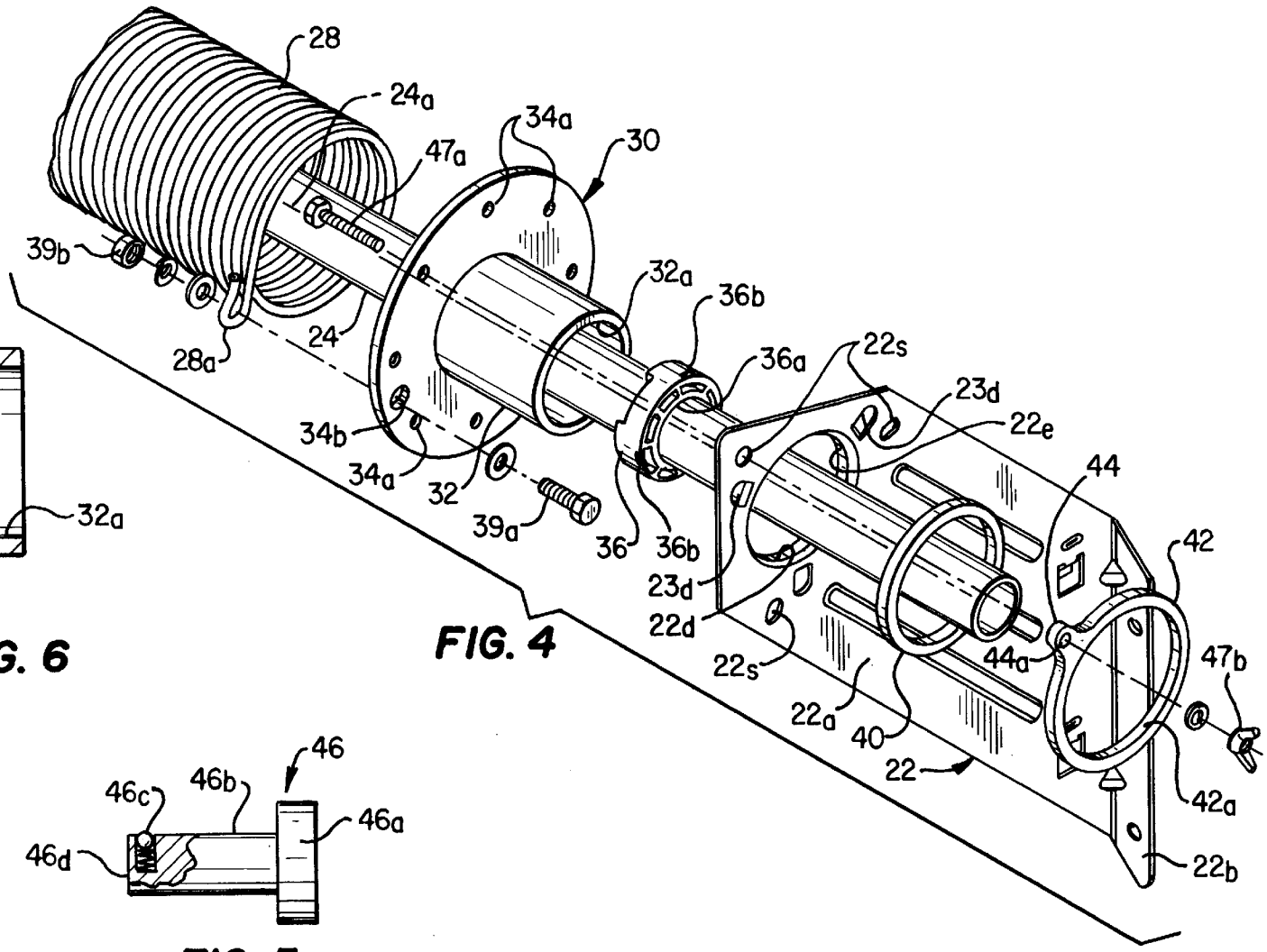
FIG. 4
FIG. 5
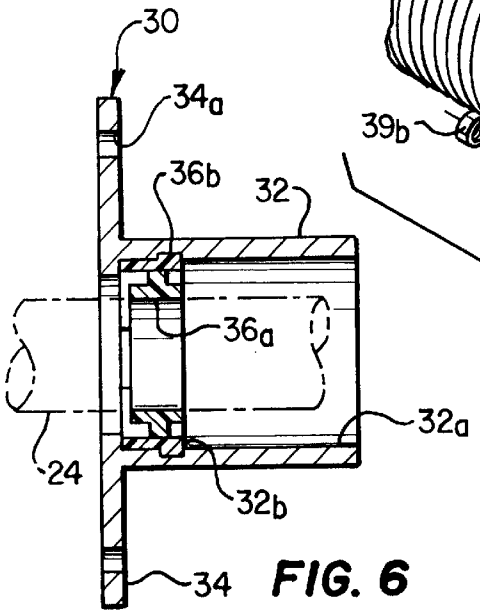
FIG. 6

COUNTERBALANCE SYSTEM ADJUSTMENT MECHANISM FOR ROLLUP DOOR

FIELD OF THE INVENTION

The present invention pertains to an adjustment mechanism for a torsion spring actuated counterbalance system for an upward acting door, particularly a rollup type door.

BACKGROUND

In the art of upward acting doors, torsion spring actuated counterbalance systems are widely used for counterbalancing the weight of the door. In rollup type or so-called sheet doors, in particular, the counterbalance mechanism is relatively uncomplicated, of necessity, to minimize the cost of fabrication and installation, since such doors are typically used in large numbers in low cost installations, such as so-called miniwarehouses. A typical rollup type door for miniwarehouse applications includes a flexible sheet closure member which is wound on a series of spaced apart drums which are supported on a rotatable shaft. The shaft is mounted on spaced apart brackets secured to a vertical wall in which the door opening is formed. At least one torsion type counterbalance spring is sleeved over and connected at one end to the door drum shaft and the opposite end of the spring is operably connected to one of the stationary wall brackets.

The adjustment of torsion type door counterbalance springs is a relatively difficult exercise and several attempts have been made to develop a simplified mechanism for adjusting and locking the torsion spring at the end which is operably fixed to the door support structure, including the so-called header bracket or wall bracket. However, in a continuing effort to improve adjustment or tensioner mechanisms for adjusting torsion springs for rollup type doors, the present invention has been developed.

SUMMARY OF THE INVENTION

The present invention provides an improved mechanism for supporting and adjusting the counterbalance system for an upward acting door, particularly a rollup or so-called sheet type door.

In accordance with one aspect of the present invention, a torsion spring adjustment mechanism is provided for adjusting a torsion spring counterbalance system for a rollup type door. The torsion spring adjustment mechanism is operable to be adjusted manually using a suitable lever, such as a long-handled pipe wrench for rotating a hub member which is connected to one end of a torsion spring, the opposite end of the spring being operably connected to a roller or drum assembly for a rollup type door.

In accordance with another aspect of the invention, a spring adjustment mechanism for a rollup door counterbalance system is provided which includes a collar secured to a hub which is connected to the torsion spring for retaining the hub in assembly with a support plate or wall bracket for supporting the door roller or drum assembly. A second reinforcing collar is secured to the support plate in concentric relationship to the hub collar and is adapted to support a lock pin which is secured to the hub at a selected rotative position of the hub to adjustment the torsional windup of a torsion spring connected to the hub.

Still further in accordance with the invention, an adjustment mechanism for a door counterbalance system is provided wherein a hub which is connected to a torsion type counterbalance spring is locked with respect to a support plate in a selected one of rotative positions by a pin which interconnects the hub with the support plate by an improved support structure including a reinforcing collar member fixed to the support plate. A door roller or drum support shaft is advantageously supported by the support plate or wall bracket through a bearing bushing, preferably formed of a self-lubricating polymer material. The shaft is free to rotate in and with respect to the bushing and the bushing is journaled by the torsion spring hub which, in turn, is normally held stationary with respect to and supported by the door supporting wall bracket.

The spring adjustment mechanism and shaft support structure of the present invention is advantageous with respect to mechanical simplicity and reliability, as well as providing for ease of spring torque adjustment thanks to the configuration and arrangement of the torsion spring hub, lock pin, the reinforcing collar and the wall bracket.

Those skilled in the art will further appreciate the above-mentioned advantages and superior features of the invention together with other important aspects thereof upon reading the detailed description which follows in conjunction with the drawing.

BRIEF DESCRIPTION OF THE DRAWINGS

FIG. 4 is an exploded perspective view of the mechanism shown in FIGS. 2 and 3;

FIG. 5 is a side elevation of a hub lock pin; and

FIG. 6 is a central section view of the hub and shaft bushing assembly.

DETAILED DESCRIPTION OF A PREFERRED EMBODIMENT

Figure 1:
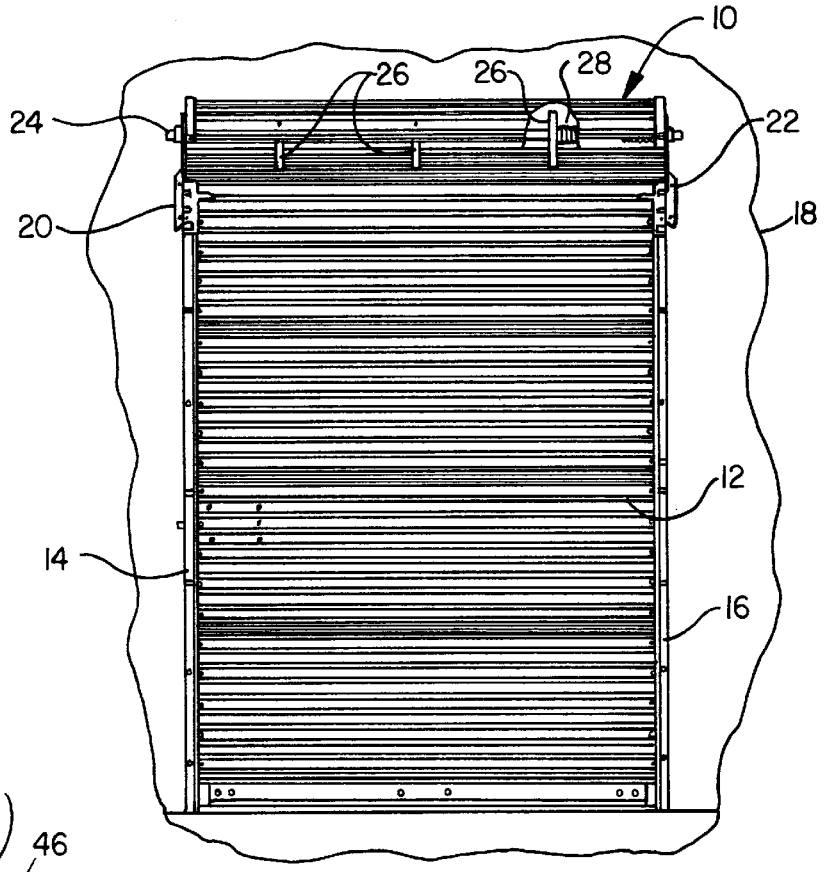
FIG. 1 is a front elevation of an upward-acting rollup type door including a counterbalance system adjustment mechanism in accordance with the present invention.

In the description which follows, like parts are marked throughout the specification and drawings with the same reference numerals, respectively. The drawing figures are not necessarily to scale and certain elements may be shown in generalized or schematic form in the interest of clarity and conciseness.

Referring to FIG. 1, there is illustrated an upward-acting door comprising a flexible rollup or sheet type door, generally designated by the numeral 10. The door 10 is of a type generally well known and includes a flexible multi-section corrugated metal panel 12 guided for movement between opposed vertically extending guide tracks 14 and 16 suitably secured to a substantially vertical wall 18 in which a door opening, not shown, is covered by the door 10 in the closed position shown. The door 10 includes opposed headplates or wall brackets 20 and 22 mounted on the wall 18 adjacent the upper ends of the guide tracks 14 and 16. A rotatable shaft 24 is mounted for rotation on the brackets 20 and 22 and is provided with plural spaced apart circular disk-like drum members 26 which are fixed to the shaft 24 for rotation therewith and are adapted to support the panel 12 in the rolled-up as well as the unrolled configuration. At least one of the drums 26 is suitably secured to one end of a torsion coil spring 28, which spring is sleeved over the shaft 24 and extends toward the wall bracket 22.

The door 10 may be provided with a single counterbalance spring, or opposed counterbalance springs, each secured to one of the drums 26 or otherwise operably secured to the shaft 24 and having their opposite ends operably secured to the respective wall brackets whereby torque may be exerted on the shaft 24 to counterbalance the weight of the door and to minimize unwanted high-speed closing movement of the door. For the sake of discussion herein, only one counterbalance spring 28 and its associated adjustment mechanism will be described in detail. Those skilled in the art will recognize that the counterbalance adjustment mechanism of the present invention may be utilized in conjunction with doors which include opposed counterbalance springs, for example.

Figure 2:
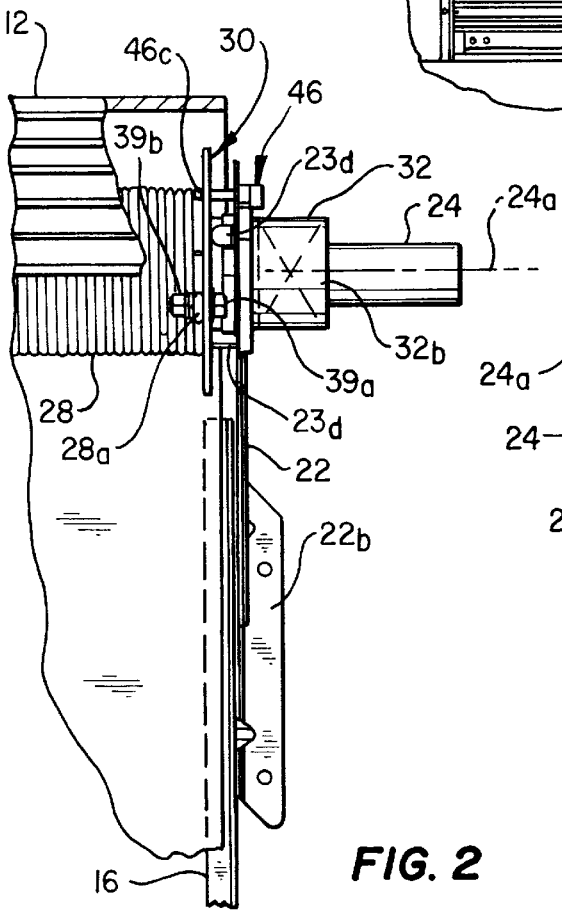
FIG. 2 is a detail front elevation of one of the door supporting wall brackets and the torsion spring connecting and supporting hub.
Figure 3:
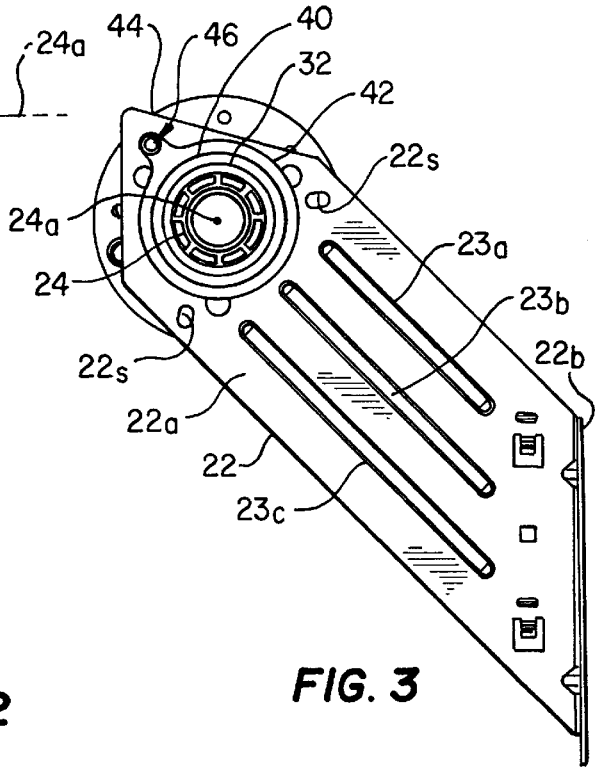
FIG. 3 is a side elevation of the hub and wall bracket assembly shown in FIG. 2.

Referring now to FIGS. 2 and 3, further details of the support bracket 22 and the spring adjustment mechanism for the spring 28 are illustrated. Reference should also be made to FIG. 4 with respect to the structure described in conjunction with FIGS. 2 and 3. As shown in FIGS. 2, 3 and 4, the support bracket 22 is preferably characterized by a relatively thin elongated metal plate portion 22*a* projecting upwardly from a transverse flange 22*b* adapted to be supported on wall 18. Spaced apart longitudinally extending plate reinforcing ribs 23*a*, 23*b* and 23*c*, FIG. 3, assist in reinforcing the plate portion 22*a*. As shown in FIG. 4, the plate portion 22*a* includes a generally cylindrical bore 22*d* delimited by a circumferential flange 22*e*. Axially projecting tabs 23*d* are formed in the plate portion 22*a* and are spaced apart circumferentially about the bore 22*d*. Each of the tabs 23*d* projects axially toward spring 28, as shown in FIG. 2. Wall bracket plate portion 22*a* is also provided with three circumferentially and equally spaced elongated slots 22*s*, see FIGS. 3 and 4, spaced about the bore 22*d*. Wall bracket 22 is adapted to be connected to guide track 16 in a manner, preferably as described in copending U.S. patent application Ser. No. 09/244,648 filed Feb. 4, 1999 and assigned to the assignee of the present invention. Wall bracket 20 is constructed essentially like wall bracket 22 but is a mirror image thereof.

As shown in FIGS. 2 and 4, torsion spring 28 is secured at one end 28*a* to a cylindrical hub 30 comprising a substantially axially extending tubular inner hub member 32 formed integral with a circumferential circular disk flange 34. The hub member 32 includes a central bore 32*a* formed therein for receiving a molded, self-lubricating polymer bearing bushing 36 in snug-fitting relationship. The bushing 36 includes a central bore 36*a*, FIG. 4, for journaling the tubular shaft 24 for rotation therein. As shown in FIGS. 4 and 6, the bushing 36 preferably includes a plurality of circumferentially spaced axially sloped and radially outwardly projecting retention tabs 36*b* which are operable to register in a circumferential groove 32*b*, see FIG. 6, in the hub central bore 32*a* to releasably retain the bushing 36 in the position shown in FIG. 6.

As also shown in FIG. 4, the hub flange 34 includes a plurality of circumferentially and equally spaced pin-receiving bores 34*a* formed therein and at least one elongated slot 34*b* interposed two of the pin-receiving bores, as shown. The hub member 32 is adapted to be received in bore 22*d* of wall bracket 22 in supported relationship by the wall bracket and is rotatable in the bore except for provision of a locking pin arrangement to be described in further detail herein for selectively securing the hub 30 in a desired rotative position with respect to shaft central axis 24*a*. As further shown in FIGS. 2 and 4, a conventional hexhead bolt and nut assembly 39*a*, 39*b* is operable to secure the hub 30 to the end 28*a* of torsion spring 28. Bolt 39*a* is adapted to project through slot 34*b* and be secured to nut 39*b* with suitable washers interposed the bolt and nut, as shown in FIG. 4. As shown in FIGS. 3 and 4, a cylindrical ring collar 40 is adapted to be sleeved over the hub member 32 and suitably secured thereto, such as by welding, when the hub member 32 has been disposed in and projecting through bore 22*d*, as shown in FIGS. 2 and 3.

The adjustment mechanism of the present invention is further characterized by a generally cylindrical ring-like collar 42 which has a cylindrical bore 42*a* slightly larger in diameter than the outside diameter of the collar 40. The collar 42 includes at least one radially projecting boss 44, FIGS. 3 and 4, having a pin-receiving bore 44*a* formed therein for receiving a lock pin 46, FIGS. 2 and 3, which is adapted to project through bore 44*a* and one of the slots 22*s* and to be engaged with hub flange 34 at one of the circumferentially spaced bores 34*a*. As shown in FIG. 5, one preferred embodiment of the lock pin 46 is preferably formed with a cylindrical head 46*a*, and a shank 46*b* which includes a spring biased ball detent retainer or lock 46*c* disposed adjacent pin distal end 46*d*. Alternatively, the means for locking the collar 42 to the hub 30 may comprise a conventional hexhead bolt 47*a*, FIG. 4, engageable with a wing nut 47*b* and used as the lock pin in place of the lock pin 46. Collar 42 may be permanently secured to the plate portion 22*a*, such as by welding, in a selected position on bracket 22 and further reinforces plate portion 22*a* as well as providing additional strength for the wall bracket 22 due to the collar's own thickness.

Accordingly, bushing 36 has a snug-fitting relationship with hub member 32, but the hub 30 may be rotatable relative to the bushing. Bushing 36 is normally stationary with respect to hub member 32 and journals the shaft 24 for rotation therein. On assembly of the hub 30 to the wall bracket 22, the hub is preferably securely retained in assembly with the wall bracket by fixing collar 40 to the hub member 32. Collar 42 may be substantially permanently secured to the bracket plate portion 22*a* with its bore 42*a* aligned with one of the slots 22*s*. When the adjustment mechanism for the torsion spring 28 is assembled to the condition shown in FIGS. 2 and 3, shaft 24 is rotatable in bushing 36 so that the door panel or sheet 12 may be rolled onto and off of the drums 26. Since one end of torsion spring 28 is secured to the hub 30 opposite the end which is connected to the shaft 24 by way of one of the drums 26, the hub 30 will tend to rotate except for the locking connection provided by the pin 46 (or pin 47*a*) and extending through bore 44*a*, a selected slot 22*s* and a selected bore 34*a* in the hub flange 34. Accordingly, the hub 30 and the torsion spring 28 may, when the pin 46 or 47*a* is removed from connection with the flange 34, be rotated to increase or decrease the torsional windup of the spring 28.

The hub 30 may be locked to the wall bracket 22 in a selected rotative position by aligning one of the bores 34*a* with the bore 44*a* in collar 42 and securing the hub in a locked position connected to the wall bracket 22 via pin 46 or 47*a*. For example, when the door 10 is assembled and the panel 12 is moved to a closed position, prior to connecting the hub 30 to the bracket 22 with the pin 46 or 47*a*, the spring 28 may be in a substantially relaxed position. At this time the hub member 32 may be engaged by a suitable tool, such as a pipe wrench, and torsional windup of the spring 28 may be accomplished by rotating the hub 30 until the counterbalance force acting on shaft 24 and drums 26 is sufficient to just begin lifting the door 12 from its closed position to a rolled-up position on the drums 26. As shown in FIG. 2, a substantial length of hub member 32, including cylindrical area 32*b*, is available for applying a tool thereto to rotate the hub 30. Once the hub 30 and the torsion spring 28 have been rotated to provided sufficient torsional counterbalance forces acting on shaft 24, hub 30 may be locked in a selected position with respect to the wall bracket 22 by extending pin 46 or 47*a* through bore 44*a*, slot 22*s* and through a selected aligned bore 34*a* whereupon the hub 30 may be then locked to the wall bracket 22, nonrotatably. If it is desired to adjust the windup of torsion spring 28 at any time, a suitable tool, such as aforementioned, is engaged with hub portion 32*b* and the hub 30 is rotated against the bias of the spring 28 to relieve any lateral forces acting on the pin 46 or 47*a* whereupon the pin may be removed from one of the bores 34*a* and the hub 30 allowed to rotate, or forced to rotate, to adjust the torsional windup of the spring 28. The pin 46 or 47*a* may then be reinserted through a bore 34*a* aligned with the slot 22*s* which is aligned with the bore 44*a* of collar 42.

Those skilled in the art will appreciate from the foregoing description that a mechanically uncomplicated and reliable torsion adjustment mechanism for adjusting the counterbalance effort on a rollup door or similar type of upward acting door is provided by the present invention. The elements described herein may be fabricated using conventional engineering materials for upward-acting door assemblies and the like and may be fabricated using conventional engineering techniques. As previously discussed, a preferred material for the bushing 36 is a molded polymer such as Nylon.

Those skilled in the art will also recognize that various substitutions and modifications may be made to the invention described herein without departing from the scope and spirit of the appended claims.

What is claimed is:

1. In an upward-acting door including spaced apart brackets, an elongated shaft supported by said brackets, a member connected to said shaft and connected to said door for transmitting forces between said shaft and said door for counterbalancing the weight of said door and a torsion counterbalance spring fixed at one end to said shaft for exerting a torsional counterbalance force on said shaft, the improvement comprising a counterbalance force adjustment mechanism including:

a hub including a tubular hub member and a circular flange having plural spaced apart pin receiving bores therein adapted to be secured to said torsion spring at an end of said torsion spring opposite the end fixed to said shaft;

at least one of said brackets including a bore for receiving said hub member in supportive relationship thereto, said shaft being supported by said hub;

a hub retaining collar for retaining said hub in assembly with said one bracket and a reinforcing collar disposed in sleeved relationship around said retaining collar and secured to said one bracket; and a lock pin operably engageable with said hub at one of said pin receiving bores and said one bracket in a selected rotative position of said hub with respect to said one bracket for adjusting the torsional windup of said torsion spring.

2. The invention set forth in claim 1 wherein:

said reinforcing collar includes a boss formed thereon and a pin receiving bore formed in said boss for receiving said lock pin in supportive relationship thereto for securing said hub nonrotatably with respect to said one bracket.

3. In an upward-acting rollup type door including spaced apart brackets, an elongated rotatable shaft supported by said brackets and operable for rolling a flexible door panel thereonto and a torsion counterbalance spring fixed at one end to said shaft for exerting a torsional counterbalance force on said shaft, the improvement comprising a counterbalance force adjustment mechanism including:

a hub adapted to be secured to said torsion spring at an end of said spring opposite the end fixed to said shaft;

a hub retaining collar for retaining said hub in assembly with said one bracket and a reinforcing collar disposed in sleeved relationship around said retaining collar and secured to said one bracket;

at least one of said brackets including a bore for receiving a portion of said hub in supportive relationship thereto, said shaft being supported by said hub;

a lock pin operably engageable with said hub and said one bracket in a selected rotative position of said hub with respect to said one bracket for adjusting the torsional windup of said torsion spring; and said hub includes a tubular hub member projecting through said bore in said one bracket and secured to said hub retaining collar and a radially extending circumferential flange including a plurality of spaced apart bores for selectively receiving said lock pin secured to said one bracket and adapted to be secured to said flange in a selected rotative position thereof.

4. The invention set forth in claim 3 wherein:

said reinforcing collar includes a boss formed thereon and a pin receiving bore formed in said boss for receiving said lock pin in supportive relationship thereto for securing said hub nonrotatably with respect to said one bracket.

5. The invention set forth in claim 3 wherein:

said reinforcing collar includes a cylindrical bore for receiving said retaining collar therein.

6. In an upward-acting door including spaced apart brackets, an elongated shaft supported by said brackets, a member connected to said shaft and connected to said door for counterbalancing the weight of said door and a torsion counterbalance spring fixed at one end to said shaft for exerting a torsional counterbalance force on said shaft, the improvement comprising a counterbalance force adjustment mechanism comprising:

a hub including a tubular hub member and a single circular flange having plural circumferentially spaced apart pin receiving bores therein and said flange being adapted to receive a connector to connect said torsion spring directly to said flange at an end of said torsion spring opposite the end fixed to said shaft;

at least one of said brackets including a bore for receiving said hub member in supportive relationship thereto, said shaft being supported by said hub;

a hub retaining collar for retaining said hub in assembly with said one bracket; and a lock pin operably engageable with said hub at one of said pin receiving bores and said one bracket in a selected rotative position of said hub with respect to said one bracket for adjusting the torsional windup of said torsion spring.

7. The invention set forth in claim 6 including:

a bushing member disposed in said tubular hub member and adapted to journal said shaft for rotation with respect to said hub.

8. The invention set forth in claim 7 wherein:

said bushing member comprises a generally cylindrical member formed of a molded polymer consisting of Nylon.

9. The invention set forth in claim 6 wherein:

said hub member includes a surface thereon for receiving a tool in engagement with said hub for rotating said hub with respect to said one bracket.

10. In an upward-acting rollup type door including spaced apart brackets, an elongated shaft supported by said brackets and operable for rolling a flexible door panel thereonto and a torsion counterbalance spring fixed at one end to said shaft for exerting a torsional counterbalance force on said shaft, the improvement comprising a counterbalance force adjustment mechanism including:

a hub adapted to be secured to said torsion spring at an end of said spring opposite the end fixed to said shaft;

at least one of said brackets including a bore for receiving a portion of said hub in supportive relationship thereto, said shaft being supported by said hub;

a hub retaining collar for retaining said hub in assembly with said one bracket;

a lock pin operably engageable with said hub and said one bracket in a selected rotative position of said hub with respect to said one bracket for adjusting the torsional windup of said torsion spring; and said hub includes a tubular hub member projecting through said bore in said one bracket and secured to said hub retaining collar and including a portion adapted to be engaged with a tool for rotating said hub member to adjust the torsional windup of said torsion spring and said hub includes a single radially extending circumferential flange including a plurality of spaced apart bores for selectively receiving said lock pin secured to said one bracket and adapted to be secured to said flange in a selected rotative position thereof and said hub is connected to said torsion spring by a connection directly between said torsion spring and said flange.

11. The invention set forth in claim 10 including:

bearing means disposed in said tubular hub member and adapted to journal said shaft for rotation with respect to said hub.

12. The invention set forth in claim 11 wherein:

said bearing means comprises a generally cylindrical bushing formed of a self lubricated bearing material.

* * * * *